US005549382A

United States Patent [19]

Correia, II et al.

[11] Patent Number: 5,549,382

[45] Date of Patent: Aug. 27, 1996

[54] STIRRER FOR FOOD PREPARATION

[76] Inventors: Bernard A. Correia, II, P.O. Box 42242, Houston, Tex. 77242; Philip B. Kirk, II, 327 Coronation, Houston, Tex. 77034

[21] Appl. No.: 429,623

[22] Filed: Apr. 27, 1995

[51] Int. Cl.[6] ..... B01F 13/08; B01F 15/06

[52] U.S. Cl. ..... 366/144; 366/146; 366/206; 366/274; 366/601; 99/348; 126/387

[58] Field of Search ..... 366/142, 144, 366/145, 146, 147, 199, 273, 274, 348, 206, 601; 219/679, 726, 620, 621, 627; 126/211, 387; 99/348

[56] References Cited

U.S. PATENT DOCUMENTS

| | | | |
|---|---|---|---|
| 2,118,120 | 5/1938 | Spang | 366/147 |
| 2,298,317 | 10/1942 | Smith | 366/147 |
| 2,518,758 | 8/1950 | Cook | 366/274 |
| 2,743,910 | 5/1956 | Melville | 366/273 |
| 2,828,950 | 4/1958 | Stilwell | 366/274 |
| 2,837,320 | 6/1958 | Baron | 366/274 |
| 3,028,476 | 4/1962 | Hug | 366/274 |
| 3,138,370 | 6/1964 | Anderson et al. | 366/274 |
| 3,433,465 | 3/1969 | Szpur | 366/274 |
| 3,554,497 | 1/1971 | Zipperer | 366/274 |
| 3,766,360 | 10/1973 | Eddleman et al. | 366/274 |
| 4,199,265 | 4/1980 | Sanderson et al. | 366/274 |
| 4,209,259 | 6/1980 | Rains et al. | 366/273 |
| 4,390,283 | 6/1983 | Meyer | 366/142 |
| 4,576,089 | 3/1986 | Chauvin | 366/142 |
| 4,747,690 | 5/1988 | Hayashi | 366/142 |
| 4,776,825 | 10/1988 | Giebeler | 366/142 |
| 4,832,501 | 5/1989 | McCauley | 99/348 |
| 4,991,973 | 2/1991 | Maaz et al. | 366/274 |
| 4,993,593 | 2/1991 | Fabiano et al. | 366/142 |
| 5,070,222 | 12/1991 | Yahav et al. | 99/348 |

FOREIGN PATENT DOCUMENTS

| | | | |
|---|---|---|---|
| 81127 | 7/1981 | Japan | 366/274 |
| 73034 | 4/1984 | Japan | 366/273 |
| 622115 | 1/1949 | United Kingdom | 366/274 |
| 892162 | 3/1962 | United Kingdom | 366/274 |
| 2074720 | 11/1981 | United Kingdom | 366/142 |
| 2082929 | 3/1982 | United Kingdom | 366/274 |

*Primary Examiner*—David Scherbel
*Assistant Examiner*—Tony G. Soohoo
*Attorney, Agent, or Firm*—Buskop Law Group; John Casperson

[57] ABSTRACT

An apparatus and method for automatically stirring foodstuffs in a kitchen environment are provided. The apparatus and method use a stove top having a plurality of cooking locations, the stove top having a top surface to support a plurality of cooking vessels and a means for heating in operable association with each of the cooking locations, and a driver means for driving an agitator device wherein the driver means is positioned in axial alignment with at least one of the cooking locations.

20 Claims, 2 Drawing Sheets

STIRRER FOR FOOD PREPARATION

BACKGROUND OF THE INVENTION

1. Field of the Invention

This invention relates to an apparatus for stirring food stuffs during food preparation which takes place on a stove top or in a microwave oven. In another aspect, this invention relates to a method for automatic, temperature controlled stirring of food stuffs prepared on a stove top or in a microwave oven.

For years cooks have had to remain close to a hot stove top or running microwave oven in order to perform stirring operations during food preparation. Without occasional to constant stirring, food may be unevenly heated, or may become lumpy or separated, or food may scorch and stick to the bottom of the cooking vessel. Currently, foods such as puddings and sauces that are cooked in a cooking vessel require intermittent or constant stirring during the cooking cycle to avoid burning or scorching. Other foods, such as soups and sauces, require stirring to mix and distribute spices, flavorings, thickeners, etc. In the past, this stirring was performed by hand. Very hot foods could splatter and bum the hand of the food preparer. An apparatus and method for automatically stirring food without nearly constant human surveillance would be desirable.

Recently, food preparation in a microwave oven has become popular. However, preparation of many foodstuffs in a microwave is actually more time-consuming on the food preparer as he or she must remain close to the microwave in order to stop the microwave and stir the food. In the case of certain sauces, this stopping/stirring sequence may be required every 15 seconds. An apparatus and method for automatically stirring food without having to stop the cooking process would be desirable.

2. Description of the Related Art

Laboratories have used magnetic stirring devices for years to create homogeneous compositions. These devices accommodate a single stirring and/or heating-stirring location. Stirring is accomplished by magnets. Although suited for heating and stirring chemicals, these apparatus are not suited for food preparation. One disadvantage is that there is no adequate control to prevent overheating and scorching as the temperature of the substance within the heating vessel rises. This requires that substantial human surveillance is needed while the laboratory apparatus is being used. Another shortcoming is that the apparatus are known only in the field of laboratory sciences and are expensive. A stirring apparatus for use in kitchen environments which eliminates constant human intervention effective is desirable.

OBJECTS OF THE INVENTION

It is a first object of this invention to provide a stirring apparatus for use during food preparation on a stove top.

It is a second object of this invention to provide a stirring apparatus for use during food preparation in a microwave oven.

It is further an object of this invention to provide an apparatus which automatically controls stirring speed to provide uniform temperature.

It is still further an object of this invention to provide a method for stirring foodstuffs which reduces human intervention.

SUMMARY OF THE INVENTION

In one embodiment of the invention, there is provided an apparatus for stirring foodstuffs in a kitchen environment. The apparatus utilizes a kitchen stove top having a plurality of cooking locations, each of which can support a cooking vessel. Each cooking location accommodates a means for heating. A driver is positioned in axial alignment with at least one of the plurality of cooking locations. The driver drives an agitator, or stirring, device. Automatic agitation of the foodstuffs allows the food preparer to perform additional tasks during the cooking process. A means may be provided to control agitation rate and or heat output automatically based upon the actual temperature of the foodstuffs or the cooking vessel. This control means helps maintain the cooking foodstuffs at a homogeneous temperature, thus reducing scorching. The agitation rate may be manually selected.

In another embodiment of the invention, there is provided an apparatus for stirring foodstuffs in a microwave oven. A driver means for driving an agitator device is positioned closely adjacent to an outside surface and parallel to an inside surface of a microwave oven. Automatic agitation allows cooking to take place in a microwave oven without the food preparer having to stop the oven to stir the food. A means may also be provided to control agitation rate and/or heat output automatically based upon the actual temperature of the foodstuffs or the cooking vessel. The agitation rate may be manually selected.

In yet another embodiment of the invention, there is provided a method for stirring foodstuffs in a kitchen environment. A stove top having a plurality of cooking locations, each of which can support a cooking vessel and each of which accommodates a means for heating is provided. A driver means for driving an agitator device is also provided, wherein the driver means is complementary to the stove top and in axial alignment with at least one of the plurality of cooking locations. A cooking vessel containing foodstuffs is placed on a cooking location which is in axial alignment with the driver means. An agitator device is placed at the bottom of the cooking vessel and the driver means is actuated to induce the agitator device to move so as stir the foodstuffs. A temperature sensor can also be provided to measure the temperature of either the foodstuffs or the cooking vessel. This temperature measurement may then be compared to a predetermined temperature and the agitation rate and/or heating output may be adjusted up or down to reach and maintain the desired, predetermined temperature.

DETAILED DESCRIPTION OF THE PREFERRED EMBODIMENTS

Figure 1:
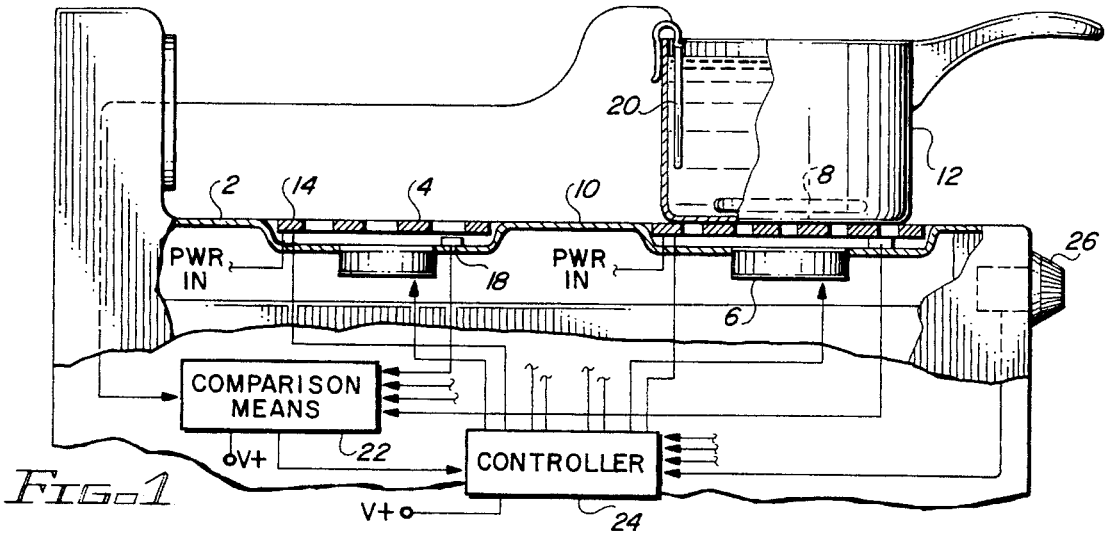
FIG. 1 is an overall view of the invention as seen on an electrically heated stove top.
Figure 2:
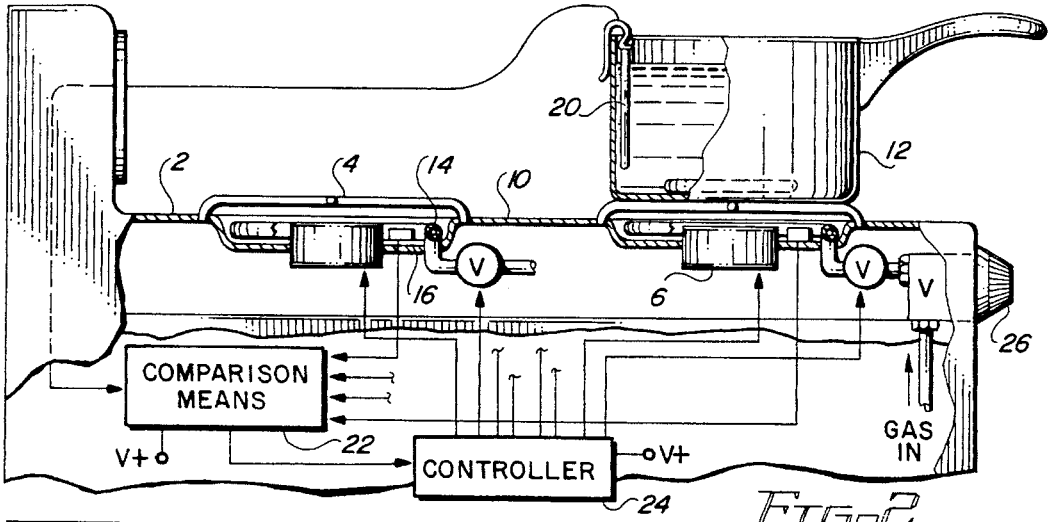
FIG. 2 is an overall view of the invention as seen on a gas heated stove top.
Figure 3:
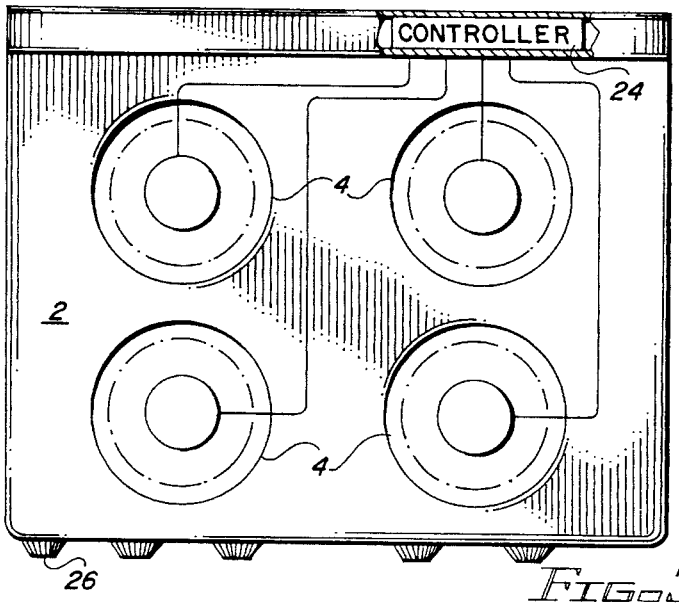
FIG. 3 is a top view of the stove top.

In accordance with certain aspects of the present invention, there is provided an apparatus for stirring foodstuffs in a kitchen environment. Referring to FIGS. 1, 2 and 3, the apparatus utilizes a stove top 2 having a plurality of cooking locations 4 and a driver means 6 for driving an agitator device 8. The stove top has a top surface 10 to support a plurality of cooking vessels 12 and a means for heating 14 in operable association with each of the cooking locations 4. The driver means 6 is positioned in axial alignment with at least one of the cooking locations 4. The means for heating 14 could be any conventional means, such as electricity, gas or halogen lamp.

Figure 4:
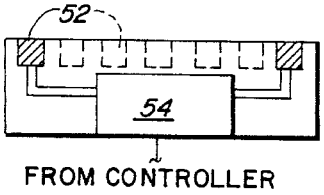
FIG. 4 is a cross-sectional view of an electromagnet array driver means.
Figure 5:
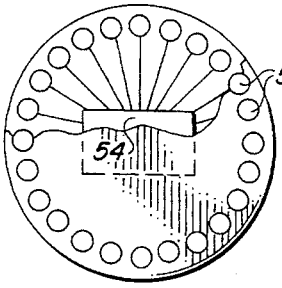
FIG. 5 is a top view of FIG. 4 showing the array of electromagnets.
Figure 6:
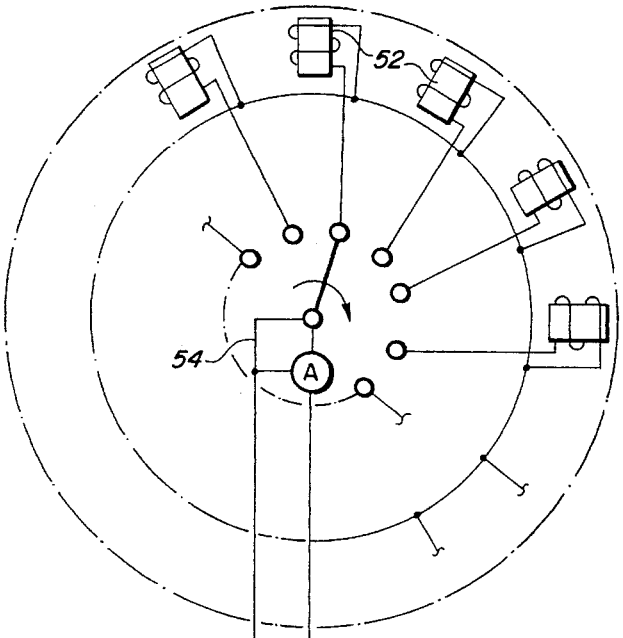
FIG. 6 shows the rotary switching device of FIG. 4.

As seen in FIGS. 4, 5 and 6, in one embodiment of the invention the driver means 6 is an array of electromagnets 52 connected to an actuator means 54 which sequentially steps a current through the array of electromagnets 52. The electromagnets are in a spaced and poled relationship to one another and the array is contained within a parameter of a circular pattern positioned in a plane parallel to the top surface 10 of the stove top 2. The diameter of the circular pattern could range from about 2.54 cm (1 inch) to about the diameter of a common cooking vessel, or approximately 20.32 cm (8 inches). The agitator device 8 is contained within a cooking vessel 12 positioned on one of the cooking locations 4 in axial alignment with the driver means 6. The agitator device 8 is made from a material which is attracted by a magnetic field. The agitator 8 may be any shape but is of a size which can fit within the cooking vessel 12 being used. The agitator 8 is attracted to each electromagnet as electric current is stepped through the array of electromagnets 52, thus spinning in the direction of the applied current.

Figure 7:
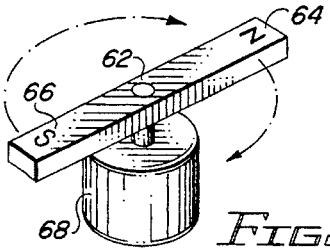
FIG. 7 shows another embodiment of the driver means wherein the driver is a rotating magnet.

In another embodiment of the invention shown in FIG. 7, the driver means 6 is a driver magnet 62 connected to a means for rotating the driver magnet 68. The driver magnet 62 has at least one positively charged polarity region 64 near an outer edge and at least one negatively charged polarity region 66 near an outer edge. The positively and negatively polarity regions are alternately positioned in a like plane. The means for rotating 68 revolves the driver magnet 62, also known as a rotating magnet, about an axis normal to the top surface 10 of the stove top 2. The driver magnet is oriented so that the positively and negatively charged polarity regions rotate in a plane substantially parallel to the top surface 10 of the stove top 2. Shown as a simplistic rectangular magnet in FIG. 7, the driver magnet could be almost any shape which is capable of being rotated about an axis. For example, the driver magnet could be disc shaped with multiple and alternating positive and negative poles around the outer parameter of the disc. The driver magnet could also be X-shaped. The agitator device 8 is an agitator magnet having at least one positively charged polarity region near an outer edge and at least one negatively charged polarity region near an outer edge. The positively and negatively polarity regions are alternately positioned in a like plane. The agitator device 8 is placed within a cooking vessel 12 positioned on one of the cooking locations 4 in axial alignment with the driver means 6 such that the agitator device will spin in a plane substantially parallel to the top surface 10 of the stove top 2. As the driver magnet 62 spins, the agitator device 8 shadows the driver magnet's rotation due to attraction of opposite poles of polarity.

In another embodiment of the invention seen in FIGS. 8, 9A, 9B and 10, the driver means 6 is a temporary magnet 72 helically wrapped with a wire 74 which is connected to an actuator 76 that sequentially steps a current through the wire. The temporary magnet 72 is formed from a material which loses its magnetism when the magnetizing cause ceases to act. The temporary magnet 72 has an outer surface and a longitudinal axis positioned perpendicular to the top surface 10 of the stove top 2. The wire 74 is helically wrapped around the outer surface of the temporary magnet 72, such that the helix has a longitudinal axis coaxial with the longitudinal axis of the temporary magnet 72. The actuator means 76 is connected to the helically wrapped wire 74 and the actuator 76 sequentially steps a current through the wire 74, creating an intermittent magnetic field. This driver means 6 is also known as a magnetic coil. An agitator device 8 is contained within a cooking vessel 12 positioned on one of the cooking locations 4 in axial alignment with the driver means 6. The agitator device 8 is a button 78 attached to a biasing means 80 which biases the button away from an internal bottom surface of a cooking vessel 12. The button 78 is formed from a material having the characteristic of being attracted towards a magnetic field while the means for biasing 80 is nonmagnetic. As current is passed through the wire 74, the button 78 is alternately attracted to, see FIG. 9B, and biased away from, see FIG. 9A, the temporary magnet 72, causing foodstuffs within the cooking vessel 12 to be agitated.

In any of the above embodiments, the means for heating 14 and/or the driver means 6 may be manually adjustable 24. In a preferred embodiment of the invention, a means for measuring temperature 16, 18, 20 and transmitting an electrical signal representative of the measured temperature is used. The means for sensing temperature may be an infrared temperature sensor 16, a contact temperature sensor 18, or a temperature probe 20. An infrared temperature sensor would be located so that it is in visual contact with the subject cooking vessel or the foodstuffs within the cooking vessel. Thus, the infrared sensor 16 may be located in the stove top, on the stove top, or even above the stove top. A contact temperature sensor 18 would be positioned so that it could come into direct contact with the subject cooking vessel 12. A temperature probe 20 would be placed in contact with the foodstuffs within the cooking vessel 12. The temperature sensor is connected to a means for comparing 22 a predetermined temperature signal to the electrical signal from the temperature sensor. For example, the food preparer could enter a predetermined temperature into the means for comparing before cooking begins. The comparing means creates and transmits an instruction signal upon comparison of the predetermined and measured signals. This instruction signal is received by a means for controlling 24 the agitation rate which is in contact with the driver means 6. The instruction signal may also be received by a means for controlling 24 heating output in contact with the means for heating 14. The instruction signal instructs the driver means 6 and/or the heater means 14 to increase or decrease output based upon whether the desired temperature is greater or lesser than the measured temperature. For example, if the desired temperature is 75° C. and the measured temperature is 80° C., the instruction signal could instruct the heater to decrease and/or the agitation rate to increase.

In a preferred embodiment of the invention, the stove top is made from a low electromagnetic interference shielding material. In a most preferred embodiment, this material would be glass or ceramic.

Figure 11:
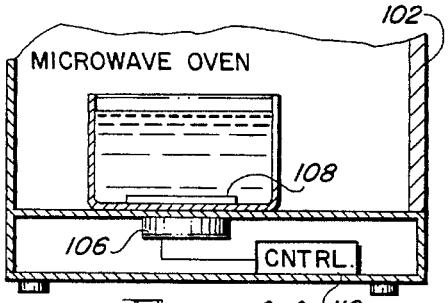
FIG. 11 is a cross-sectional view of the agitator device and driver means as positioned for use in a microwave oven.
Figure 8:
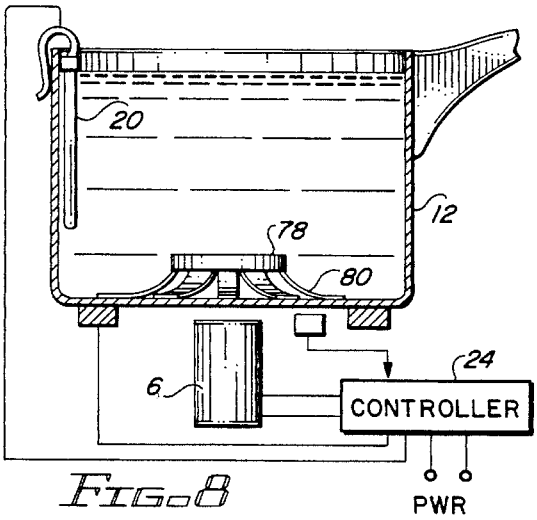
FIG. 8 shows a further embodiment of the driver means wherein the driver is an electromagnet and the agitator device is a biased magnetic button.
Figure 9A:
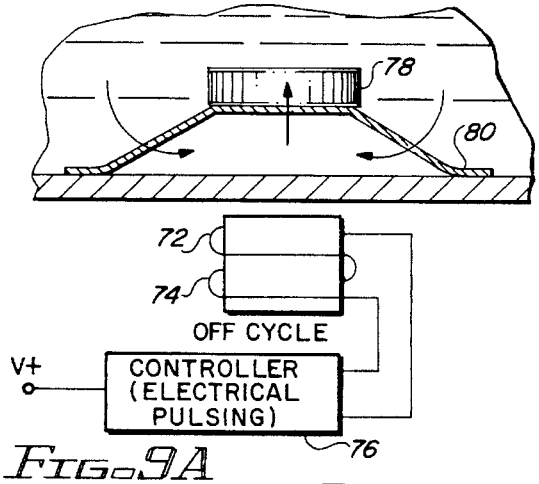
FIG. 9A shows the agitator device of FIG. 8 in the repelled, or away, position.
Figure 9B:
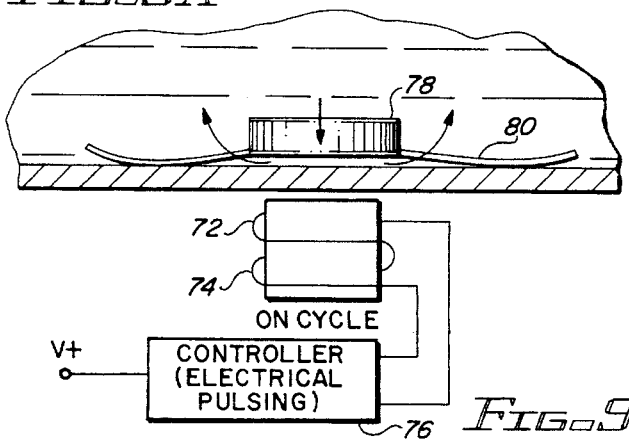
FIG. 9B shows the agitator device of FIG. 8 in the attracted, or close, position.
Figure 10:
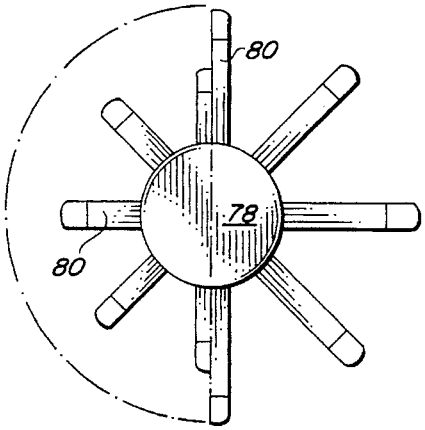
FIG. 10 is a top view of the agitator device showing the device in both the repelled position of FIG. 9A (left side of FIG. 10) and the attracted position of FIG. 9B (right side of FIG. 10).

Referring to FIG. 11, in another aspect of the invention, there is provided an apparatus for stirring foodstuffs in a microwave oven 102. The apparatus includes a driver means 106 for driving an agitator device 108 and a means for positioning the driver means closely adjacent to an outside surface and parallel to an inside surface of the microwave oven.

As described above, the driver means 106 is usually an array of electromagnets 52 connected to an actuator means 54, a rotating magnet 62 connected to a means for rotating the driver magnet 68, or a magnetic coil 72 helically wrapped with a wire 74 which is connected to an actuator 76. The various agitator devices 8 for use with these drivers are as described above. The means for heating and the driver means 106 may both be manually adjustable 26.

As described previously, a preferred embodiment of the invention includes a means for measuring temperature 16, 18, 20 and transmitting an electrical signal representative of the temperature measured. The temperature sensor is connected to a means for comparing 22 a predetermined temperature to the measured temperature. The means for comparing signals 22 then creates and transmits an instruction signal based upon the comparison. This instruction signal is received by a means for controlling 110 the agitation rate and/or a means for controlling heat output.

In another aspect of the invention, a method is provided for stirring foodstuffs in a kitchen environment. A stove top 2, substantially as described previously, is provided. The stove top has a plurality of cooking locations 4, the ability to support a plurality of cooking vessels 12, and accommodates a means for heating 14 in operable association with each the plurality of cooking locations 4. A driver means 6 for driving an agitator device 8 is also provided. The driver means is complementary to the stove top 2 and in axial alignment with at least one of the plurality of cooking locations 4. A cooking vessel 12 containing foodstuffs and an agitator device 8 is placed on the at least one of the plurality of cooking locations 4 in axial alignment with the driver means 6. The agitator device 8 is preferable generally near the bottom of the cooking vessel 12. The driver means 6 is then actuated to induce the agitator device 8 to stir the foodstuffs contained within the cooking vessel 12.

As described previously, the driver means 6 may be an array of electromagnets 52, a rotating magnet 62 or a magnetic coil 72. The agitator devices 8 for use with these drivers are substantially as described above. The means for heating 14 and the driver means 6 may both be manually adjustable 26.

In a preferred embodiment of the invention, at least one predetermined temperature level is set and entered into a means for comparing temperature signals 22. The temperature of the cooking vessel or the foodstuffs is measured with a means for measuring temperature 16, 18, 20 and transmitting an electrical signal representative of said temperature. This measured temperature signal is transmitted to the means for comparing 22 the measured temperature signal and the predetermined temperature. The measured signal and the predetermined temperature are then compared and an instructional signal is determined. This instructional signal is transmitted to a means for controlling agitation rate 24 and/or to a means for controlling heating rate 24. The agitation rate of the agitator device 8 and/or the heating output of the means for heating 14 are then controlled to maintain the foodstuffs at a predetermined temperature.

As previously described, the means for measuring temperature 16, 18, 20 may be an infrared sensor 16 in visual contact with the cooking vessel or the foodstuffs within the cooking vessel, a contact sensor 18 in near physical contact with the cooking vessel, or a temperature probe 20 in contact with the foodstuffs. The stove top 2 is formed from a low electromagnetic interference shielding material, preferably glass or ceramic.

In a further embodiment of the invention, at least one predetermined cooking time can be set. A timing signal may then be sent to the means for controlling agitation rate 24 and the driver means 6 can be turned off at a predetermined time or a predetermined temperature. A second timing signal may be sent to the means for controlling heating rate 24 and the means for heating 14 can be turned off at this second predetermined time or a second predetermined temperature.

The present invention may be subject to many modifications and changes without departing from the spirit or essential characteristics thereof. The present embodiments should therefor be considered in all respects as illustrative and not restrictive of the scope of the present invention as defined by the appended claims.

We claim:

1. An apparatus for stirring foodstuffs in a kitchen environment comprising:

a kitchen stove top having a at least one cooking location, said kitchen stove top having a top surface to support at least one kitchen cooking vessel;

a kitchen cooking vessel;

a means for heating foodstuffs in operable association with each said at least one cooking location;

an agitator device disposed in said kitchen cooking vessel, wherein the agitator device is positioned at a bottom surface of said kitchen cooking vessel;

a driver means for driving said agitator device wherein said driver means is magnetically coupled to said agitator device;

a means for actuating the driver means to induce said agitator device to stir the foodstuffs contained within said kitchen cooking vessel;

wherein the driver means is positioned in axial alignment with at least one of said at least one cooking location, said driver means further positioned beneath the top surface of said kitchen stove top;

a means for temperature control comprising:

means for sensing temperature for one of said foodstuffs or said kitchen cooking vessel to obtain a measured temperature signal;

means for setting at least one predetermined temperature signal;

means for sending said measured temperature signal from the means for sensing temperature to a means for comparing said signal of said sensed temperature to said at least one predetermined temperature signal;

means for comparing the measured temperature signal to said at least one predetermined temperature signal to determine an instructional signal;

means for transmitting said instructional signal to a means for controlling the agitator device;

means for controlling the agitator device;

means for transmitting said instructional signal to a means for controlling said means for heating foodstuffs; and means for controlling the agitator device relative to the compared signal.

2. An apparatus as in claim 1 wherein the driver means comprises:

an array of electromagnets in a spaced and poled relationship to one another; and an actuator means connected to each said electromagnet through wiring means, said actuator means having the characteristic of sequentially stepping a current through the array of electromagnets;

wherein said array of electromagnets is contained within a parameter of a circular pattern positioned in a plane parallel to the top surface of the kitchen stove top; and wherein the agitator device is contained within a kitchen cooking vessel positioned on one of said plurality of cooking locations in axial alignment with said driver means.

3. An apparatus as in claim 1 wherein the driver means comprises:

a driver magnet having at least one positively charged polarity region near an outer edge of said driver magnet and at least one negatively charged polarity region near an outer edge of said driver magnet, said at least one positively charge polarity region and said at least one negatively charged polarity region alternately positioned in a like plane; and a means for rotating said driver magnet about an axis normal to the top surface of the stove top connected to the driver magnet;

wherein the driver magnet is oriented so the at least one positively charged polarity region and the at least one negatively charged polarity region rotate in a plane substantially parallel to the top surface of the stove top; and wherein the agitator device is contained within a cooking vessel positioned on one of said plurality of cooking locations in axial alignment with said driver means, said agitator device positioned to rotate in a plane substantially parallel to the top surface of the stove top;

said apparatus further comprising an agitator device comprising an agitator magnet having at least one positively charged polarity region near an outer edge of said agitator device and at least one negatively charged polarity region near an outer edge of said agitator device, said at least one positively charged polarity region and said at least one negatively charged polarity region alternately positioned in a like plane.

4. An apparatus as in claim 1 wherein the driver means comprises:

a temporary magnet having an outer surface and a longitudinal axis positioned perpendicular to said top surface of the stove top;

a wire helically wrapped around the outer surface of the temporary magnet, said helix having a longitudinal axis coaxial with the longitudinal axis of said temporary magnet; and an actuator means connected to said wire, said actuator means having the characteristic of sequentially stepping a current through the wire;

said apparatus further comprising an agitator device comprising a button formed from a material having the characteristic of being attracted towards a magnetic field, and a means attached to said button for biasing said button away from an internal bottom surface of a cooking vessel.

5. An apparatus as in claim 1 wherein the means for heating is manually adjustable and wherein the driver means is manually adjustable.

6. An apparatus as in claim 1 wherein the means for measuring temperature comprises an infrared sensor in visual contact with a kitchen cooking vessel or foodstuffs within a kitchen cooking vessel positioned on one of said plurality of cooking locations in axial alignment with said driver means.

7. An apparatus as in claim 1 wherein the means for measuring temperature comprises a contact sensor positioned near one of said plurality of cooking locations in axial alignment with said driver means and in juxtaposed relationship to a kitchen cooking vessel.

8. An apparatus as in claim 1 wherein the means for measuring temperature comprises a temperature probe positioned in foodstuffs contained in a kitchen cooking vessel positioned on one of said plurality of cooking locations in axial alignment with said driver means.

9. An apparatus as in claim 1 wherein the kitchen stove top is made from a low electromagnetic interference shielding material selected from the group consisting of glass and ceramic.

10. A method for stirring foodstuffs in a kitchen environment said method comprising:

providing a kitchen stove top having at least one cooking location to support at least one kitchen cooking vessel; wherein said kitchen stove top accommodates a means for heating foodstuffs in operable association with at least one cooking location;

providing a driver means for driving an agitator device by magnetically coupling said agitator device to said driver means, wherein said driver means is complementary to said kitchen stove top and in axial alignment with said at least one cooking location, said driver means further positioned beneath a top surface of said kitchen stove top;

placing a kitchen cooking vessel on said at least one cooking location in axial alignment with said driver means, wherein the kitchen cooking vessel contains foodstuffs;

placing an agitator device in said kitchen cooking vessel, wherein said agitator device is positioned at a bottom surface of said kitchen cooking vessel, said agitator device further being magnetically coupled to said driver means such that actuation of said driver means results in movement of said agitator device;

actuating the driver means to induce the agitator device to stir the foodstuffs contained within said kitchen cooking vessel;

providing a temperature sensor for one of said foodstuffs in said at least one cooking vessel and setting at least one predetermined temperature signal;

measuring temperature with a means for measuring temperature and transmitting an electrical temperature signal representative of said measured temperature;

transmitting said electrical temperature signal and said predetermined temperature signal to a means for comparing temperature signals;

comparing said electrical temperature signal to said predetermined temperature signal to determine an instructional signal;

transmitting said instructional signal to a means for controlling agitation rate;

transmitting said instructional signal to a means for controlling heating rate; and controlling the agitation rate of the agitator device and the heating rate of the means for heating to maintain said foodstuffs at said at least one predetermined temperature.

11. A method as in claim 10 wherein the driver means comprises an array of electromagnets and an actuator means.

12. A method as in claim 10 wherein the driver means comprises:

a driver magnet having at least one positively charged polarity region near an outer edge of said driver magnet and at least one negatively charged polarity region near an outer edge of said driver magnet, said at least one positively charge polarity region and said at least one negatively charged polarity region alternately positioned in a like plane; and a means for rotating said driver magnet about an axis normal to the top surface of the stove top connected to the driver magnet;

wherein the driver magnet is oriented so the at least one positively charged polarity region and the at least one negatively charged polarity region rotate in a plane substantially parallel to the top surface of the stove top; and wherein the agitator device is contained within a cooking vessel positioned on one of said plurality of cooking locations in axial alignment with said driver means, said agitator device positioned to rotate in a plane substantially parallel to the top surface of the stove top;

said apparatus further comprising an agitator device comprising an agitator magnet having at least one positively charged polarity region near an outer edge of said agitator device and at least one negatively charged polarity region near an outer edge of said agitator device, said at least one positively charged polarity region and said at least one negatively charged polarity region alternately positioned in a like plane.

13. A method as in claim 10 wherein the driver means comprises:

a temporary magnet having an outer surface and a longitudinal axis positioned perpendicular to said top surface of the stove top;

a wire helically wrapped around the outer surface of the temporary magnet, said helix having a longitudinal axis coaxial with the longitudinal axis of said temporary magnet; and an actuator means connected to said wire, said actuator means having the characteristic of sequentially stepping a current through the wire;

said apparatus further comprising an agitator device comprising a button formed from a material having the characteristic of being attracted towards a magnetic field, and a means attached to said button for biasing said button away from an internal bottom surface of a cooking vessel.

14. A method as in claim 10 wherein the means for measuring temperature comprises an infrared sensor in visual contact with the kitchen cooking vessel or foodstuffs within said kitchen cooking vessel positioned on said at least one cooking location in axial alignment with said driver means.

15. A method as in claim 10 wherein the means for measuring temperature comprises a contact sensor positioned near said least one cooking location in axial alignment with said driver means and in juxtaposed relationship to said kitchen cooking vessel.

16. A method as in claim 10 wherein the means for measuring temperature comprises a temperature probe positioned in foodstuffs contained in said kitchen cooking vessel positioned on said at least one cooking location in axial alignment with said driver means.

17. A method as in claim 10 wherein the kitchen stove top is formed from a low electromagnetic interference shielding material selected from the group consisting of glass and ceramic.

18. A method as in claim 10 wherein the means for heating and the driver means are manually controlled.

19. A method as in claim 10 further comprising;

setting at least one predetermined cooking time;

transmitting a first timing signal to a means for controlling agitation rate; and turning off said driver means at a first predetermined time or a first predetermined temperature;

transmitting a second timing signal to a means for controlling heating rate; and turning off said means for heating at a second predetermined time or a second predetermined temperature.

20. A method as in claim 19 further comprising:

transmitting a second timing signal to a means for controlling heat rate; and turning off said means for heating at a second predetermined time or a second predetermined temperature.

* * * * *